United States Patent [19]

Miskin

[11] 4,436,442

[45] Mar. 13, 1984

[54] DIRECTORY HOLDER

[76] Inventor: Renold A. Miskin, 1722 Roberta St., Salt Lake City, Utah 84115

[21] Appl. No.: 427,885

[22] Filed: Sep. 29, 1982

Related U.S. Application Data

[63] Continuation of Ser. No. 159,960, Jun. 16, 1980, abandoned, which is a continuation of Ser. No. 892,997, Apr. 3, 1978, abandoned.

[51] Int. Cl.[3] ..... B42F 13/00

[52] U.S. Cl. ..... 402/73; 248/447; 281/49; 281/45; 281/33

[58] Field of Search ..... 248/441 R, 445, 447, 248/451, 454, 455; 281/29, 33, 34, 45, 46, 48, 49, 18, 21 R; 402/4, 70, 71, 72, 73, 74, 75, 76, 77, 78

[56] References Cited

U.S. PATENT DOCUMENTS

| | | | |
|---|---|---|---|
| 1,004,802 | 10/1911 | Martin | 281/46 |
| 1,197,610 | 9/1916 | Darling | 281/33 |
| 1,564,594 | 12/1925 | Leh | 281/33 X |
| 1,890,840 | 12/1932 | Brewer | 281/45 |
| 1,911,799 | 5/1933 | Buchan | 248/447 |
| 1,984,711 | 12/1934 | Van Alstyne | 281/33 X |
| 2,832,348 | 4/1958 | Demarest, Jr. | 402/77 X |
| 2,834,148 | 5/1958 | Walter et al. | 248/447 |
| 3,617,074 | 11/1971 | Rigolini | 281/49 X |
| 3,635,351 | 1/1972 | Homs | 248/447 X |
| 3,860,212 | 1/1975 | Nawman | 281/45 X |

FOREIGN PATENT DOCUMENTS

| | | | |
|---|---|---|---|
| 695551 | 12/1930 | France | 281/49 |
| 12451 | of 1910 | United Kingdom | 281/49 |
| 17579 | of 1910 | United Kingdom | 281/49 |
| 518389 | 2/1940 | United Kingdom | 281/49 |

*Primary Examiner*—Paul A. Bell

*Attorney, Agent, or Firm*—Terry M. Crellin

[57] ABSTRACT

A directory holder adaptable for mounting in various places comprising a bed and a cover of rigid sheet material such as acrylic hingeably attached to each other at side flanges, top flange on cover, bottom flanges on bed and cover which overlap when closed forming a case, upper and lower pivoting retaining clips, and a security means to prevent easy removal of directory, referred to as basic directory holder and useful as a portable directory. An adaptation for mounting the basic directory holder on a wall comprises a wall board with mounting tabs and a pencil tray, the top edge of the basic directory holder hingedly attached to upper portion of the wall board, and a positioning brace pivotally attached to bed. The brace is adapted to be moved between first and second positions so that the basic directory holder at two distinctive positions relative to the wall board.

10 Claims, 17 Drawing Figures

DIRECTORY HOLDER

The present application is a continuation of U.S. application Ser. No. 159,960, filed June 16, 1980, which in turn was a continuation of U.S. application Ser. No. 892,997, filed Apr. 3, 1978. Both application Ser. Nos. 159,960 and 892,997 are now abandoned.

SUMMARY OF THE INVENTION

This invention relates generally to book holders and more particularly to a telephone directory holder that is quick and convenient to use in searching for telephone numbers and other information present in such directories. The directory holder of the present invention also preserves the directory to keep it in good appearance.

Because of the very usefulness of telephone directories and the demand on each one by a number and a variety of people, these directories generally become badly abused and unsightly. Not only that, but they are many times in inconvenient places in businesses and homes and their locations must often be searched out.

BACKGROUND OF THE INVENTION

In the prior art, book holders have been patented that were primarily designed for handicapped and bed-ridden people and for people doing much reading such as students. Some of these inventions utilized devices such as rods and clamps to hold the book open, but these book holders are not efficient for holding telephone directories, especially for short intermittent uses.

There are several patents of telephone directory holders intended for use in phone booths in which cases means are described for holding the directory in a hanging position below a shelf and for swinging it to a position above the shelf where it can be opened. These directory holders provide security for the directory and make it possible to locate a number with time and patience. However, considering all the circumstances under which telephone directories are used, no satisfactory means has heretofore been provided whereby a telephone directory can be kept in a ready-to-use position for quick and easy reference in a convenient location of one's choosing in a position of comfort to the user, and of pleasant appearance.

OBJECTS OF THE INVENTION

Although the basic directory holder and adaptations of my present invention were developed with the use in mind of holding telephone directories they can be utilized to hold any other type of directory, catalog, or book.

Therefore it is a principal object of my invention to provide a basic directory holder that may be used as a portable directory holder and that is adaptable for mounting in various ways and various locations for convenience as desired and which has a holder bed and a cover that give complete support and protection to the directory whether closed or open to any page from the first to the last whether horizontal or in a steep position, and which is provided with clip means that retain the directory in proper position within the directory holder in closed and in all open positions for free and easy turning of all pages, and that is provided with security means to prevent easy removal of the directory from the basic directory holder.

It is another object of my present invention to provide an alternate basic directory holder with an extended holder bed with writing space, and with paper holding clip board clip means.

It is another object of my invention to provide, as an adaptation to my basic directory holder, panel means for mounting said basic directory holder on a wall or the like, hinge means at the top of the basic holder for hingeably attaching it to said panel, and position-holding brace means that automatically positions itself to support the basic directory holder at either a gradual or steep slope as desired for quick use and for comfort and good posture of the user.

It is another object of my present invention, as another adaptation of my basic directory holder, with base means for using said basic directory holder on a desk or the like, with hinge means at the bottom of the holder bed for pivoting the basic holder to the preferred slope, and with position-holding brace means that automatically positions itself to support the basic directory holder in either a steep or reclining position for quick use and for comfort and good posture of the user.

It is still another object of my present invention to provide, as another adaptation of my basic directory holder, plate mounting means and hinge means for hingeably mounting said basic directory holder at the edge of a desk or the like for pivoting it from a folded position off said desk to save space to a using position on the end of said desk, and vice verse.

Various other objects and advantages of my present invention will be readily apparent from the detailed description when considered in connection with the accompanying drawings forming a part thereof, and in which:

BRIEF DESCRIPTION OF THE DRAWINGS

FIG. 1 is a perspective view of the basic directory holder of my invention shown in closed position and is taken from the lower right side and viewed as lying on a desk or the like.

DETAILED DESCRIPTION

Figure 1:
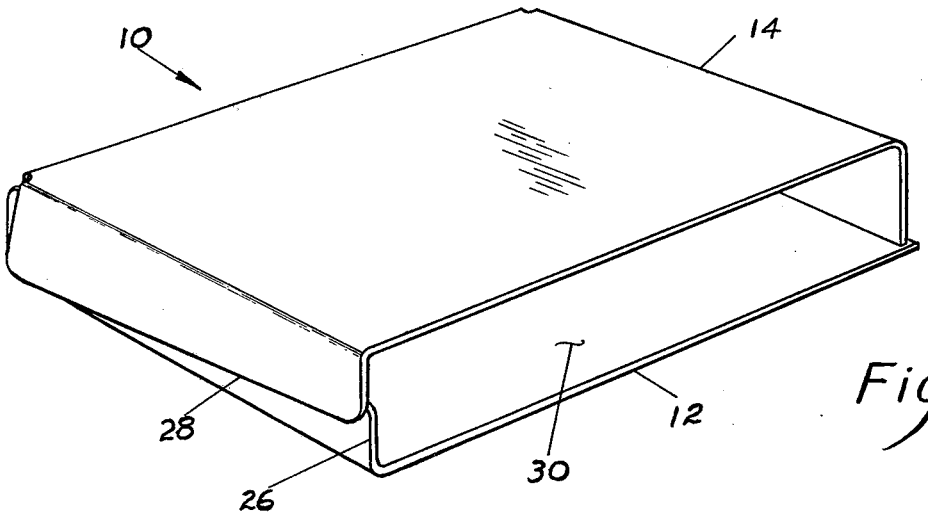

Referring to the drawings for further disclosure and clarification, the numeral 10 designates the basic directory holder portion of my invention and as such is the portable unit which the user may take with him for use whereever needed such as in an automobile or the like.

Figure 2:
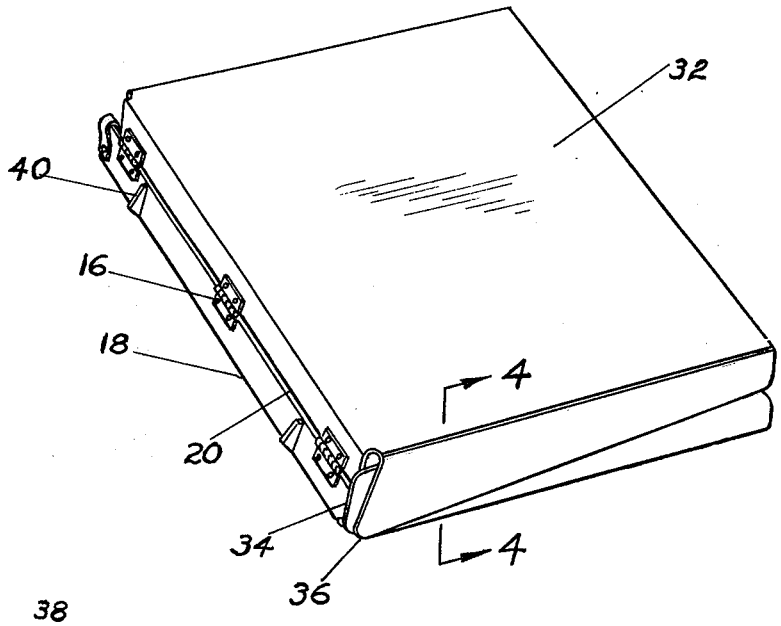
FIG. 2 is a lower left perspective view of my basic directory holder also in closed position.
Figure 3:
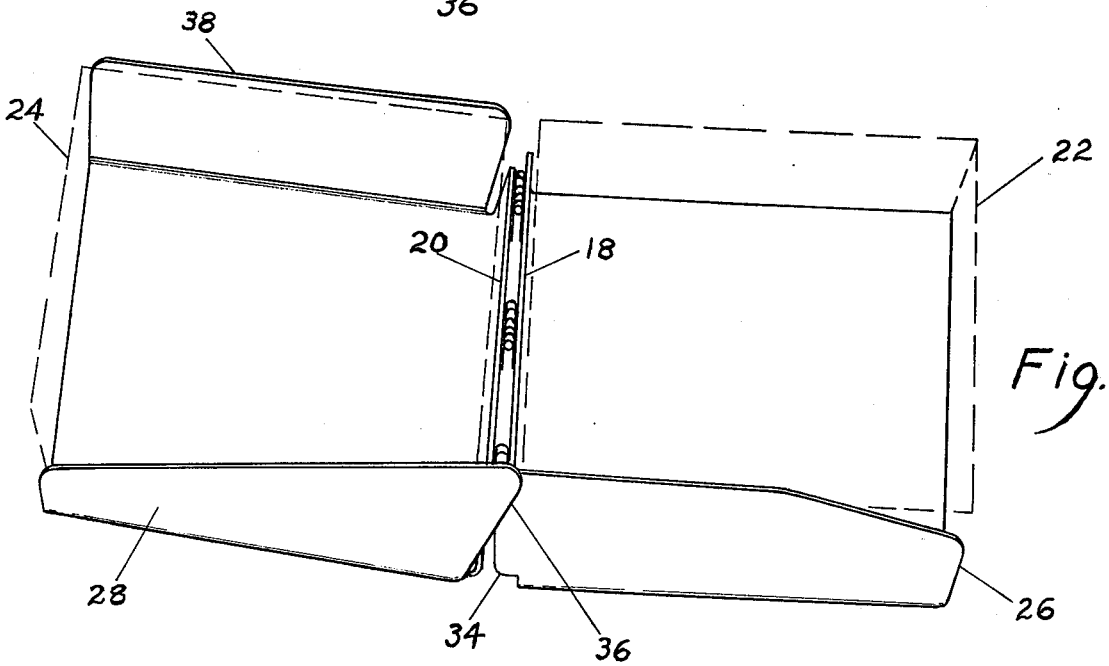
FIG. 3 is a lower front perspective view of my basic directory holder shown in open position. The clips and security loop are not shown in this view for clarity.

As illustrated in the drawings, my basic directory holder contains the directory within a holder bed 12 and cover 14 which are best made of rigid material such as sheet metal or sheet acrylic. The basic directory holder opens and shuts similar to a conventional rigid brief case, being hingedly connected along the spine by hinges 16 on the bed hinge flange 18 and cover hinge flange 20, to correspond to the way a book normally opens and shuts. Refer to FIGS. 1, 2 and 3.

To use the basic directory holder of my invention the holder cover 14 is turned open from right to left like turning the cover of a book to start reading at the beginning. Or, if the user prefers, he may open the basic holder and the directory to any section he chooses such at the middle with one stroke. Or, the complete directory may be turned over from one side to the other with ease so that it rests completely in the bed 12 as shown by the broken lines 22 or in the cover 14 as indicated by the broken lines 24 of FIG. 3.

Support means for the directory beneath the bottom of the directory, which is considered the side nearest the user, is provided by bed bottom flange 26 and by cover bottom flange 28 which are essentially panels extending perpendicularly from bed panel 30 and cover panel 32. When the basic directory holder is at a steep angle of slope and open, the bed bottom flange 26 provides support of the directory when it rests entirely in the holder bed 12 and cover bottom flange 28 provides support for the directory when it rests entirely in the cover.

Likewise, the bed bottom flange supports only a portion of the directory and the cover bottom flange supports the remainder when it is opened at any page between the first and the last. It will be noted in FIG. 3 that both bottom support flanges extend approximately the same distance in width and that they therefore have the same directory support capability.

Figure 4:
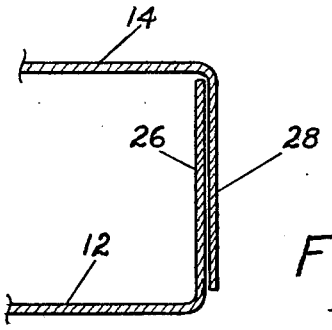
FIG. 4 is a partial cross sectional view taken along lines 4—4 of FIG. 2.

It will also be noted that when the basic directory holder is closed that the cover bottom flange overlaps the bed bottom flange, allowing the basic directory holder to close completely to near directory size without interference. Refer to FIGS. 1, 2 and 4.

The left end 34 of the bed bottom flange is extended to the left past the hinge line and the cover corner 36 is also extended past the hinge line so that the two flanges remain slightly overlapped when the basic directory holder is completely open thereby providing means for preventing interference that might otherwise might occur because of the close fit between the two flanges. This is clearly illustrated in FIG. 2 showing the basic directory holder in closed position and in FIG. 3 showing it in open position.

The bottom flanges are tapered on the outer ends to reduce interference with a person's hand in pointing out telephone numbers and other information.

Cover top flange 38 adds to the good appearance of the basic telephone directory holder of my invention and provides dust protection means.

Wedges 40 are triangular braces which are an integral part of the holder bed and protect the hinges against stress when weight is on the cover in open position.

Figure 5:
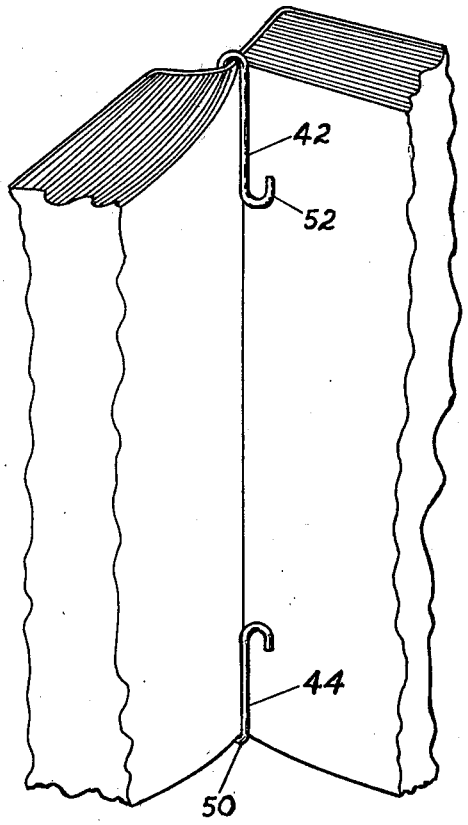
FIG. 5 is a perspective broken-away upper view of the middle section of a directory and shows the clips in place.

To maintain the directory in proper position within the basic directory holder, clips are provided which spraddle over the edges of the directory spine, one at the top and one at the bottom and fit between the pages at about the middle of directory as seen in FIG. 5. The clip at the top is referred to as position pin 42 and the clip at the bottom as cradle pin 44.

Figure 6:
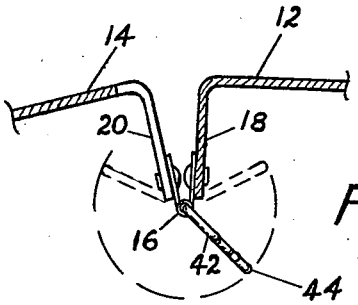
FIG. 6 is a cross sectional view taken along the lines 6—6 of FIG. 7.
Figure 7:
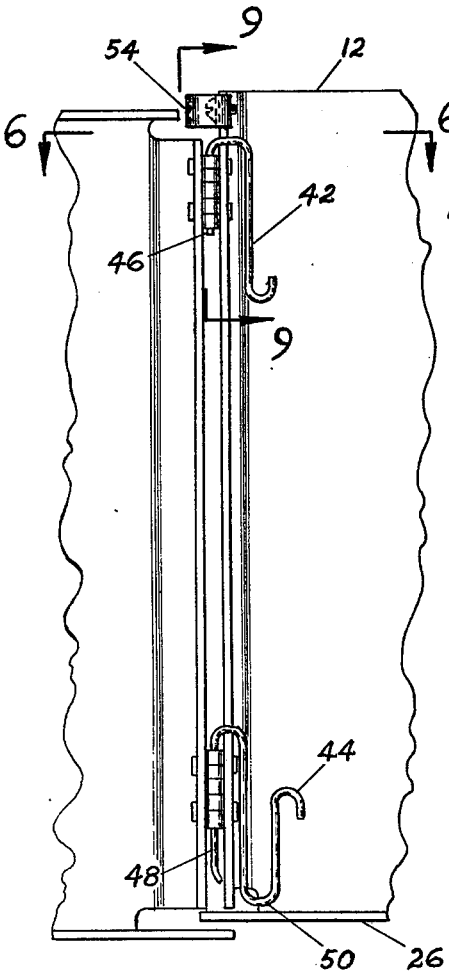
FIG. 7 is a broken-away front view of the middle section of my basic directory holder shown in open position.

As seen in FIGS. 6 and 7, the back portion 46 of the position pin 42 is inserted into the top hinge 16 and the back portion 48 of the cradle pin 44 is inserted into the bottom hinge and serve as hinge pins. This arrangement provides means for allowing the directory to pivot about the same hinge line as does the holder bed and the holder cover.

FIG. 6 illustrates the extent of sweep of the position pin and the cradle pin as they pivot from one extreme position to the other. The position pin and the cradle pin can pivot independently of each other so that they need not be at the same angle. Since the spine of the directory is kept close to the hinge line by the position pin and the cradle pin and since they allow the directory to pivot to the extreme positions indicated, directories of various thicknesses may be used with equal ease in the basic directory holder of my invention.

In referring to the illustrations of the cradle pin shown in FIGS. 5 and 7 it is seen that the spine of the directory rests in the bottom of the loop 50 of said cradle pin and that the loop is located a short distance above the bed bottom flange 26. Thus means are provided for carrying the wight of the spine portion of the directory, thereby allowing the directory to pivot freely without dragging.

Even though the cradle pin carries a large share of the weight of the directory, the bottom flanges support the pages when the directory is open and prevent them from drooping and collapsing which they would be inclined to do, especially when the directory is used in the steep position.

To install a directory in the basic directory holder of my invention, the security loop is rotated to vertical position and the position pin is removed. The directory is then set in the bottom loop of the cradle pin which cannot be removed because of the bend in the back portion 48. The position pin is then replaced in the hinge with the front portion reaching over the top of the directory spine as seen in FIG. 5. The security loop is then locked again in horizontal position.

Figure 8:
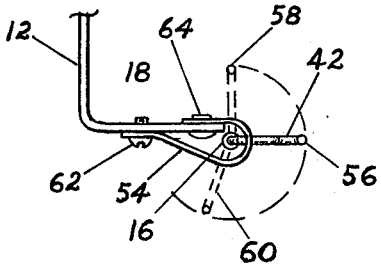
FIG. 8 is a top view of FIG. 9.
Figure 9:
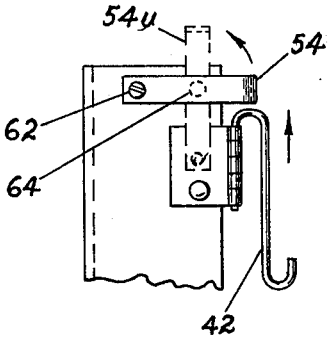
FIG. 9 is a broken-away view taken along the lines 9—9 of FIG. 7.

To prevent easy removal of the directory from the basic directory holder, security loop 54 is provided and located a short distance above the position pin. Refer to FIGS. 7, 8, and 9. Since, in order to remove the directory from the basic directory holder, it is necessary to lift the position pin upward as indicated by the arrow in FIG. 9, security loop 54 as shown in solid lines in locked position, prevents removal of the position pin and therefore removal of the directory.

FIG. 8 shows that the security loop continues to block removal of the position pin whether it is in the middle position at 56 or swung to the extreme right or to the extreme left as indicated at 58 and 60.

Lock screw 62 is provided, bed hinge flange 18 is tapped with matching threads, and rivet 64 is left loose enough to allow pivoting of the security loop, thereby providing means for installing the security loop in the locked position and for pivoting it, after removal of the lock screw, to the unlocked position indicated by broken lines at 54*u*. The lock screw may be a type of fastener requiring a special removal tool if desired.

My basic directory holder is thus above described and is a portion of my present invention which also includes an alternate directory holder and mounting adaptations for the two directory holders.

Figure 10:
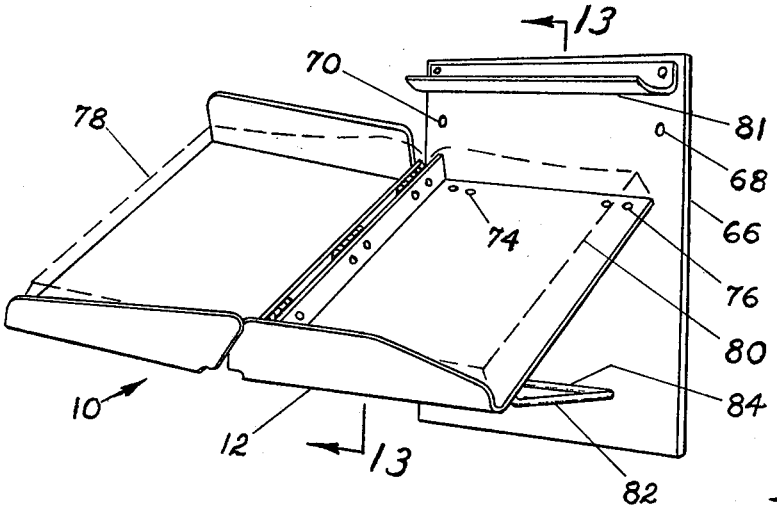
FIG. 10 is a perspective view of the basic directory holder as adapted to be mounted on a wall or the like and is shown opened and in the sloping position.
Figure 11:
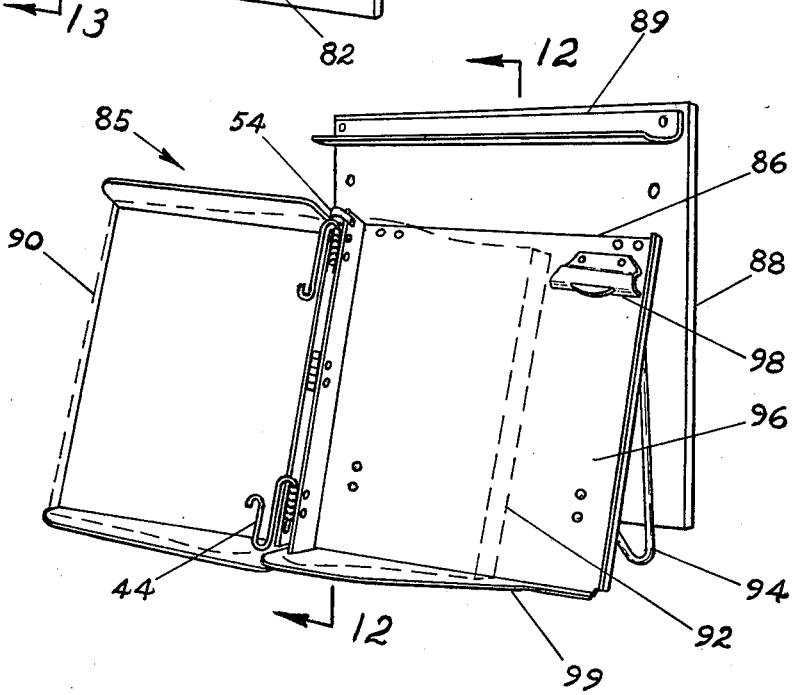
FIG. 11 is a perspective view of my basic directory holder as adapted to be mounted on a wall and is also shown opened but in the steep position. The illustration shows that the holder bed is wider to provide writing space and space for a clip board clip.

The adaptation for mounting my basic directory holder on a wall or the like is illustrated in FIGS. 10 and 11. Wall board 66 is provided for attaching directly against the wall with fasteners at 68 and 70 as shown in FIG. 10. The basic directory holder is hingeably attached to the wall board with hinges 72 behind the top edge of the holder bed at 74 and 76. Broken lines 78 and 80 illustrate how the directory appears lying open in the basic directory holder of my invention. The cradle pin, position pin, and the security loop are not shown in FIG. 10 for clarity.

Pencil care tray means 81 is provided as an added convenience and is rigidly attached to the wall board as shown in FIG. 10.

Figure 12:
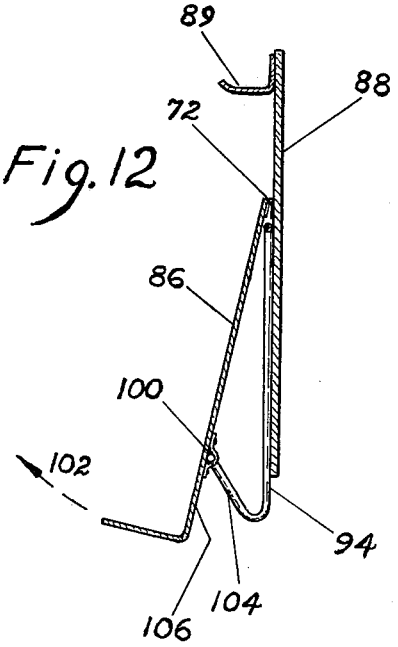
FIG. 12 is a cross-sectional view taken along the lines 12—12 of FIG. 11.
Figure 13:
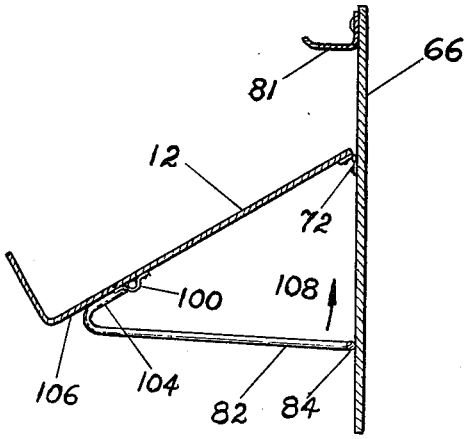
FIG. 13 is a cross-sectional view taken along the lines 13—13 of FIG. 10.

Slope positioning and bracing means 82 is provided the basic directory holder for automatically positioning and bracing said basic directory holder in either the sloping position as shown in FIGS. 10 and 13 or in the steep position as shown in FIGS. 11 and 12. Lateral portion 84 of slope brace 82 extends to near the width of the holder bed, as shown in FIG. 10.

FIG. 11 illustrates my alternate directory holder 85 in a wall-mounted adaptation. It will be noted that the alternate 85 is identical to the basic directory holder 10 except for the holder bed 86 which is wider to provide writing space 96 and space for clip board clip 98 as note-taking conveniences, and which has a long tapered bottom flange 99 and side flange 101 to give rigidity to the holder bed 86. Broken lines 90 and 92 illustrate how an open directory appears in my alternate directory holder appears hanging in the near-vertical steep position.

Said alternate directory holder as a separate unit is also portable for use in traveling, for instance.

The adaptation for mounting my alternate directory holder on a wall or the like is illustrated in FIG. 11 and is similar to the adaptation for mounting my basic directory holder on a wall as illustrated in FIG. 10 except that wall board 88 and slope brace 94 are wider and pencil tray member 89 is longer to correspond with the wider holder bed 86. Wall board 88 is rigidly attached to a wall or the like and holder bed 86 is hingedly mounted with hinges 72 behind the top edge of said holder bed to said wall board. Refer to FIGS. 11 and 12.

In the wall-mounted adaptations, slope positioning and brace means, 82 for the basic directory holder and 94 for the alternate, are provided.

FIGS. 12 and 13 illustrate how said slope braces hold the basic and the alternate directory holders of my invention when mounted on a wall or the like in the steep position (Refer to FIG. 12) and in the sloping position (Refer to FIG. 13.) and also illustrate how they are changed from one position to another.

The covers, hinge flanges, cradle pins, position pins, nor the security loops are shown in FIGS. 12 and 13 for clarity.

Slope braces 82 and 94, of generally U shape, appear identical in the side view as a J and they both function in the same manner so that the following applies to both directory holders.

The slope brace pivots in brace bearing means 100 mounted on the underside of the holder bed. If it is desired to move the directory holder from the steep position to the sloping position, for example, the holder bed may be grasped at the bottom and swung upwardly as indicated by arrow 102 until the slope brace has automatically pivoted downward to the generally horizontal position as illustrated in FIG. 13 where it automatically stops as a result of the contact of the short portion 104 of the slope brace with the lower underside 106 of the holder bed.

If it is desired to move the directory holder of my invention from the sloping position for instance, as shown in FIGS. 10 and 13, to the steep position as shown in FIGS. 11 and 12 the lateral portion 84 of the slope brace is pivoted manually upward as shown by arrow 108 of FIG. 13 until the slope brace has no bracing effect. The slope brace and the directory holder are then pivoted automatically to the position shown in FIGS. 11 and 12 by the weight of the directory holder and directory.

Figure 14:
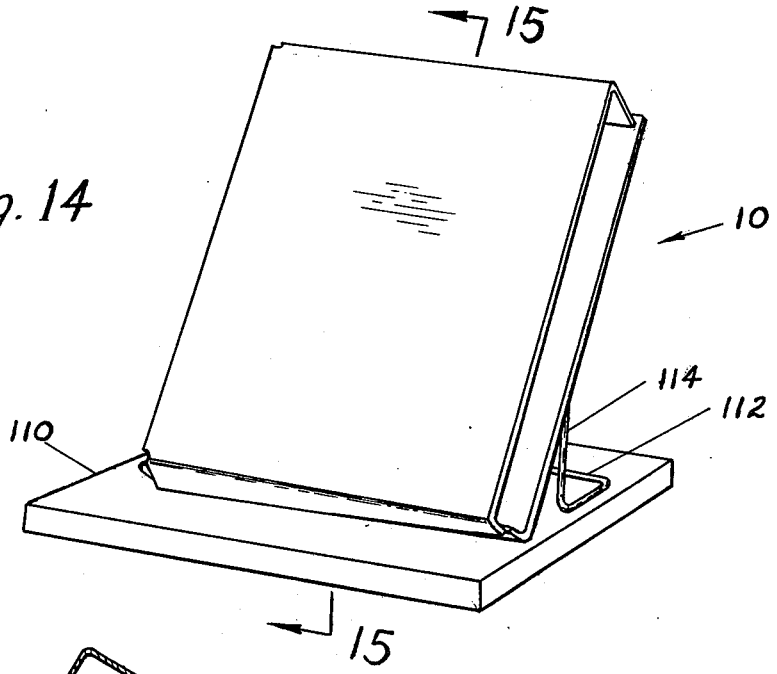
FIG. 14 is a right front perspective view of my basic directory directory holder mounted on a base board and adapted to be used on a desk or the like and which is shown closed and in the steep position.
Figure 15:
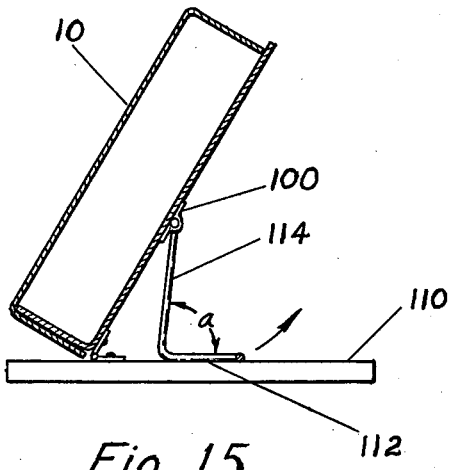
FIG. 15 is a cross-sectional view of the basic directory holder and adaptation shown in FIG. 14.
Figure 16:
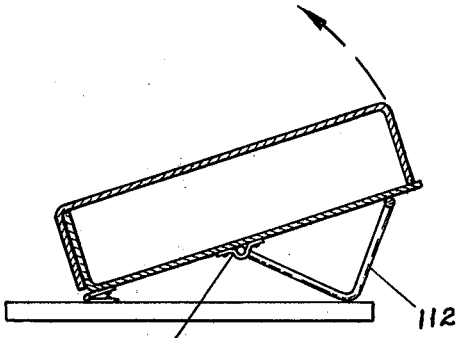
FIG. 16 is also a cross-sectional view of the basic directory holder and adaptation of FIG. 14 but illustrates the basic directory holder in the reclining position and the supporting brace for that position.

Referring to FIG. 14, it is seen that the basic directory holder of my invention there illustrated is adapted for use on a desk or the like. A rectangular shaped base 110 of sufficient weight for stability is provided on which the directory holder is mounted. The basic directory holder is hingeably mounted at the bottom of the holder bed to the base as best seen in FIGS. 15 and 16. The basic directory holder is mounted nearer the right side of the base for added stability when the directory holder is open and the weight of the directory is on the cover.

Slope brace 112 is provided which is L shaped in the side view as illustrated and U shaped in the front and rear views. Angle "a" of slope brace 112 is less than 90 degrees to give bracing stability in the position shown in FIG. 15. Brace bearings 100 are provided and the slope brace is pivotally mounted therein on the back side of the holder bed as illustrated in FIGS. 15 and 16.

If it is desired to change the slope of the basic directory holder from the steep position as shown in FIGS. 14 and 15 to the reclining position as shown in FIG. 16, the slope brace 112 is grasped at the vertical portion 114 and moved rearward as indicated by the arrow in FIG. 15 until the slope brace has no bracing effect. The basic directory holder will then automatically pivot to the reclining position by its own weight and the slope brace will automatically pivot about the brace bearing and assume its position shown in FIG. 16, supporting the directory holder in the reclinging position.

Figure 17:
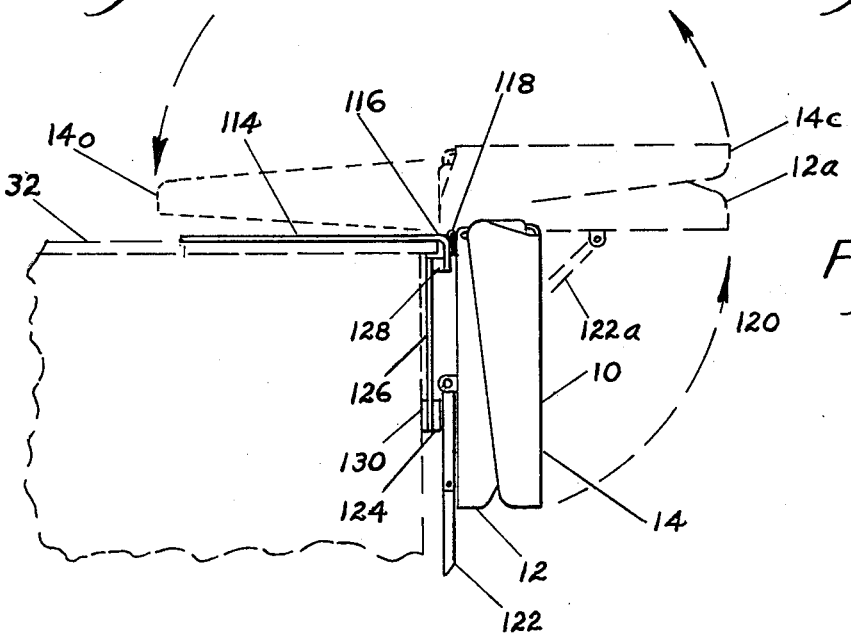
FIG. 17 illustrates my basic directory holder adapted for mounting on the end of a desk or the like. The broken lines show it in ready-to-use position and the dotted lines indicate the cover as opened.

The adaptation of my basic directory holder for mounting at the edge of a desk or the like to save space is illustrated in FIG. 17. Plate 114 which lies flat on the desk has flange 116 to which the basic directory holder of my invention 10 is pivotally attached by hinges 118. The view of the basic directory holder as seen in this illustration is the bottom side with the right hand side down. To read the directory, the user grasps the lower portion of the bed 12 and pivots it up as indicated by arrow 120 until it is level with the top of the desk as indicated by broken lines 12*a*. Brace 122, pivotally attached to the underside of the bed, is swung over to the left and the lower end is placed on the top side of block 124 for support. Block 124 is rigidly attached to bar 126 which is suspended from flange 116. Spacer 128 offsets the bar for utilization of the space beneath the desk top ledge. Pad 130 is for contact with the desk vertical surface.

The cover in closed position is indicated by broken lines 14*c* and in open position by dotted lines 140. The brace 122 is preferably of a Y configuration with the single end downward. The desk is shown in broken lines 132 as a front view.

The basic directory holder is just as easily mounted on the left edge of the desk and functions so just as well in which case the cover is hingeably attached to the bracket 116.

Thus, from the foregoing description it is readily apparent that my present invention provides a new and novel basic directory holder which is portable for carrying where needed and which is pleasant in appearance and easy to use. My basic directory holder invention provides new and novel bed and cover means with bottom flange support means which give complete protection and support to the directory, and new and novel clip means as directory position retaining and pivoting means for easy searching in the directory used at various angles including near vertical position. The basic directory holder also provides new and novel locking means to prevent easy removal of the directory from my directory holder invention.

My present invention also provides a new and novel alternate directory holder, also portable, with wider holder bed for writing space and a clip board clip as added conveniences.

My present invention further provides new and novel mounting and bracing means for utilizing my basic and alternate directory holders in various positions and locations for saving space and for quick and convenient searching.

The present invention also provides new and novel pencil care means for convenience and also variable positioning and bracing means that allow the user to stand or sit in comfort and good posture according to his needs while searching in the directory.

It is also readily apparent that my present invention may be economically manufactured of inexpensive materials and parts and that it lends itself to production in beautiful colors and finishes to suit the owner.

Various changes in the dimensions, form, configuration, and adaptations of my invention shown and described herein may be made without departing from the spirit of the invention, the scope of which is set forth in the appended claims.

What I claim as new and novel and desire to protect by Letters Patent is:

1. A directory holding device for containing, preserving and securing a directory such as a telephone directory, said directory holding device comprising:

(a) bed means adapted to receive a directory;

(b) cover means;

(c) hinge means adapted for hingedly attaching said cover means, along one side thereof, to a mutually respective side of said bed means, so that the cover means can be moved from a closed position in which it substantially overlies said bed means to an open position in which it lies substantially adjacent to said bed means, whereby said cover means is adapted to cover the directory when said cover means is in the closed position overlying said bed means and to receive any portion of the directory when said cover means is in the open position lying adjacent to said bed means;

(d) flange support means at the respective bottom ends of said bed means and said cover means for supporting the pages of a directory when any portion of said directory is received in said bed means and said cover means;

(e) positioning pin means comprising a generally inverted U-shaped member having a front portion and a straight back portion which is bent back over said front portion, with said straight back portion being adapted to serve as a hinge pin in said hinge means, whereby said positioning pin means may pivot about the hinge line of said hinge means, and with said front portion of said positioning pin means being adapted to extend downwardly between pages of the directory to maintain the top side of the directory in a proper position;

(f) cradle pin means comprising an elongate pin member having a straight central portion with opposite end portions which are bent back in opposite directions over the central portion so as to form a top loop defined by one of the end portions and the central portion and a bottom loop defined by the other end portion and the central portion, with the one end portion forming said top loop serving as a hinge pin in said hinge means whereby said cradle pin means is adapted to pivot about the hinge line of said hinge means, and whereby the other end portion forming said bottom loop being adapted to extend upwardly between pages of the directory such that the directory is supported by said bottom loop; and (g) security means adapted to prevent easy removal of said positioning pin means from said hinge means and subsequently easy removal of a directory from said directory holding device, said security means comprising an elongate tab means mounted for movement from a first position to a second position, wherein in said first position a portion of said tab means extends over said positioning pin means blocking the removal of said positioning pin means from said hinge means, and wherein in said second positon, the tab means clears said positioning pin means so that said positioning pin means can be removed from said hinge means.

2. The device of claim 1 wherein said bed and cover means are hingeably connected at side flanges for opening of said cover means from right to left.

3. The device of claim 1 wherein the lower end of said front portion of said positioning pin means is bent upward to avoid tearing the pages of the directory when the positioning pin means is being put in place between pages of the directory.

4. The device of claim 1 wherein the free end of said back portion of said cradle pin is bent below said hinge means to prevent removal of said cradle pin from said hinge means.

5. The device of claim 1 wherein said security means is adapted to be rotatably moved between said first and second positions, with the security means being offset and parallel to said hinge line of said hinge means whereby said positioning pin means can be removed from said hinge means.

6. The device of claim 1 wherein said flange support means on said bed and said cover overlap when the cover is in its closed position, and each of the respective flange means has a width which is substantially the same dimension as the depth of the directory holding device when said cover is in its closed position.

7. The device of claim 1 further comprising in combination means for mounting the device on a wall or the like.

8. The device of claim 1, wherein the means for mounting the device on the wall or the like comprises:

a wall board which is adapted to be firmly attached to a wall for support;

pivotal connecting means for connecting the upper side edge of the bed means of said device to said wall board so that said device can pivot from a rest postion in which it hangs downwardly from said pivotal connecting means to an elevated position in which said device extends outwardly from said pivotal connecting means to make an acute angle with said wall board;

brace means adapted to lie substantially flatwise adjacent to said bed means and between said bed means and said wall board when the directory holding device is in its rest position, said brace means further being adapted to extend longitudinally between the lower portion of said bed means and the wall board when the directory holding device is in its elevated position, whereby the brace means supports said directory holding device in its elevated position.

9. The device of claim 8, wherein the brace means comprises an elongate rod which is bent into a generally U-shape, the free ends of the legs of the U-shaped brace means are bent back so that the bent back portions form an acute angle with the respective legs of the U-shaped brace means, said bent back portions also being positioned in a common plane, said free ends of the legs of the U-shaped brace means being pivotally attached to the lower surface of said bed means such that the U-shaped brace means can be pivoted between a first position in which the U-shaped member lies substantially against said wall board and a second position in which the bent back portions of said legs contact the lower surface of said bed means and the U-shaped member extends outwardly from the lower surface of said bed means.

10. A wall mounted directory holding device comprising:

(a) a bed means adapted to receive a directory;

(b) cover means;

(c) hinge means adapted for hingedly attaching said cover means, along one side thereof, to a mutually respective side of said bed means, so that the cover means can be moved from a closed position in which it substantially overlies said bed means to an open position in which it lies substantially adjacent to said bed means, whereby said cover means is adapted to cover the directory when said cover means is in the closed position overlying said bed means and to receive any portion of the directory when said cover means is in the open position lying adjacent to said bed means;

(d) flange support means at the respective bottom ends of said bed means and said cover means for supporting the pages of a directory when any portion of said directory is received in said bed means and said cover means;

(e) a wall board which is adapted to be firmly attached to a wall for support;

(f) pivotal connecting means for connecting the upper side edge of said bed means to said wall board so that the directory holding device can pivot from a rest position in which it hangs downwardly from said pivotal connecting means to an elevated position in which the directory holding device extends outwardly from said pivotal connecting means to make an acute angle with said wall board;

(g) brace means adapted to lie substantially flatwise adjacent to said bed means and between said bed means and said wall board when the directory holding device is in its rest position, said brace means further being adapted to extend longitudinally between the lower portion of said bed means and the wall board when the directory holding device is in its elevated position, whereby the brace means supports said directory holding device in its elevated position, said brace means comprising an elongate rod which is bent into a generally U-shape, the free ends of the legs of the U-shaped brace means are bent back so that the bent back portions form an acute angle with the respective legs of the U-shaped brace means, said bent back portions also being positioned in a common plane, said free ends of the legs of the U-shaped brace means being pivotally attached to the lower surface of said bed means such that the U-shaped brace means can be pivoted between a first position in which the U-shaped member lies substantially against said wall board and a second position in which the bent back portions of said legs contact the lower surface of said bed means and the U-shaped member extends outwardly from the lower surface of said bed means.

* * * * *